US008434846B2

(12) United States Patent
Tanaka

(10) Patent No.: US 8,434,846 B2
(45) Date of Patent: May 7, 2013

(54) LIQUID EJECTING APPARATUS AND LIQUID EJECTING METHOD

(75) Inventor: Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 291 days.

(21) Appl. No.: 12/696,758

(22) Filed: Jan. 29, 2010

(65) Prior Publication Data

US 2010/0194806 A1 Aug. 5, 2010

(30) Foreign Application Priority Data

Jan. 30, 2009 (JP) ..... 2009-019200

(51) Int. Cl.
*B41J 29/38* (2006.01)

(52) U.S. Cl.
USPC ..... 347/14

(58) Field of Classification Search ..... 347/14, 347/17, 19
See application file for complete search history.

(56) References Cited

U.S. PATENT DOCUMENTS 5,946,007 A 8/1999 Otsuka et al.
2002/0041300 A1* 4/2002 Iwasaki et al. ..... 347/19
2003/0231234 A1* 12/2003 Ushirogouchi et al. ..... 347/100

FOREIGN PATENT DOCUMENTS

JP 06-182997 7/1994

* cited by examiner

*Primary Examiner* — Laura Martin
(74) *Attorney, Agent, or Firm* — Workman Nydegger

(57) ABSTRACT

A liquid ejecting apparatus including a liquid ejecting head which ejects a liquid from a nozzle passage, a heating unit which heats and dries the liquid attached to an ejection medium, a temperature measuring unit which is disposed at a predetermined region near the liquid ejecting head, a temperature calculating unit which calculates a temperature of the liquid ejected from the liquid ejecting head based on the initial temperature measurement and a temperature correction table which associates time obtained after operation of the heating unit with a temperature of the liquid and which calculates a temperature of the liquid based on a descending correction table associating a difference between a temperature obtained immediately after interruption of the heating unit and an outside ambient temperature, and a driving waveform correcting unit which corrects a head driving waveform of the liquid ejecting head on the basis of a calculation result.

7 Claims, 10 Drawing Sheets

FIG. 4

| T0 | T0=15°C | T0=20°C | T0=25°C | T0=30°C | T0=35°C | T0=40°C |
|---|---|---|---|---|---|---|
| Ts | 44°C | 44°C | 44°C | 44°C | 44°C | 44°C |
| S0 | 60 min | 55 min | 50 min | 45 min | 39 min | 33 min |
| S (min) | Ti (°C) | | | | | |
| 0 | 15 | 20 | 25 | 30 | 35 | 40 |
| 1 | 15 | 20 | 25 | 30 | 35 | 40 |
| 2 | 16 | 21 | 25 | 30 | 35 | 40 |
| 3 | 16 | 21 | 26 | 31 | 35 | 40 |
| | | | 26 | 31 | 36 | 40 |
| 36 | 34 | 37 | 40 | 42 | | |
| 37 | 34 | 38 | 41 | 42 | 44 | Th |
| 38 | 35 | 38 | 41 | 43 | 44 | Th |
| 39 | 36 | 39 | 42 | 43 | 44 | Th |
| 40 | 36 | 40 | 42 | 43 | Th | Th |
| 41 | 37 | 40 | 42 | 43 | Th | Th |
| 42 | 37 | 41 | 43 | 44 | Th | Th |
| 43 | 38 | 41 | 43 | 44 | Th | Th |
| 44 | 39 | 41 | 43 | 44 | Th | Th |
| 45 | 39 | 42 | 43 | 44 | Th | Th |
| 46 | 40 | 42 | 43 | Th | Th | Th |
| 47 | 40 | 42 | 44 | Th | Th | Th |
| 48 | 41 | 43 | 44 | Th | Th | Th |
| 49 | 41 | 43 | 44 | Th | Th | Th |
| 50 | 42 | 43 | 44 | Th | Th | Th |
| 51 | 42 | 43 | Th | Th | Th | Th |
| 52 | 43 | 43 | Th | Th | Th | Th |
| 53 | 43 | 44 | Th | Th | Th | Th |
| 54 | 43 | 44 | Th | Th | Th | Th |
| 55 | 43 | 44 | Th | Th | Th | Th |
| 56 | 43 | Th | Th | Th | Th | Th |
| 57 | 44 | Th | Th | Th | Th | Th |
| 58 | 44 | Th | Th | Th | Th | Th |
| 59 | 44 | Th | Th | Th | Th | Th |
| 60 | 44 | Th | Th | Th | Th | Th |
| 61 | Th | Th | Th | Th | Th | Th |

DETECTION TEMPERATURE OF HEAD THERMISTOR AND INK TEMPERATURE

LIQUID EJECTING APPARATUS AND LIQUID EJECTING METHOD

The entire disclosure of Japanese Patent Application No. 2009-019200, filed Jan. 30, 2009 is expressly incorporated herein by reference.

BACKGROUND OF THE INVENTION

1. Technical Field

The present invention relates to a liquid ejecting apparatus and a liquid ejecting method. More specifically, the present invention relates to a heating mechanism and heating method for a liquid ejecting apparatus.

2. Related Art

Typically, ink jet printers include a heating mechanism which is disposed near a printing head which are used to dry the print surface of a print medium, such as a sheet of paper. These heating mechanism are particularly useful in printers which use a large-scale printing head called a line head, which executes printing at a high speed, in order to quickly dry the print surface of the print medium.

One difficulty with the configurations currently used in the art, however, is that when the heating mechanism is used to dry the print surface, the temperature of the printing head may increase, causing the viscosity of the ink to vary. The variation in viscosity makes it necessary to correct the head driving waveform of the printing head. Moreover, a temperature detecting unit has to be mounted to detect whether an increase or variation in the temperature of the printing head has occurred. Japanese Patent Application No. JP-A-6-182997 discloses a technique in which a head thermistor is used as a temperature detecting unit which is used to correct the head driving waveform of the printing head based on the temperature detected by the head thermistor.

One problem with the mechanism described in JP-A-6-182997, however, is that the ink is a liquid and any increase in the temperature is slight due to a specific heat capacity. For this reason, when the heating mechanism operates, the detection temperature of the head thermistor is easily higher than an actual temperature of the ink. As a consequence, a large gap may occur between the actual temperature of the ink and the detection temperature of the thermistor. When there is a large gap between the actual temperature of the ink and the detection temperature of the thermistor, it is difficult to appropriately correct the head driving waveform of the printing head.

In particular, when the heating mechanism is interrupted, the actual temperature of the ink may decrease, causing an even greater gap between the actual temperature of the ink and the detection temperature of the thermistor. As a consequence, it is more difficult to appropriately correct the head driving waveform of the printing head.

BRIEF SUMMARY OF THE INVENTION

An advantage of some aspects of the invention, there is provided a liquid ejecting apparatus and a liquid ejecting method capable of correcting a head driving waveform of a liquid ejecting head to an appropriate head driving waveform, even when a heating mechanism is interrupted.

A first aspect of the invention is a liquid ejecting apparatus comprising a liquid ejecting head which ejects a liquid from a nozzle to an ejection medium, a heating unit which heats and dries the liquid ejected to the ejection medium, a temperature measuring unit which is disposed at a predetermined region near the liquid ejecting head and measures a temperature of the predetermined region, a temperature calculating unit which calculates a temperature of the liquid ejected from the liquid ejecting head based on an initial temperature measurement of the temperature measuring unit and a temperature correction table which associates an amount of time elapsed after operation of the heating unit with a temperature of the liquid and which calculates a temperature of the liquid to be ejected from the liquid ejecting head based on a descending correction table which associates a difference between a temperature immediately after interruption of the heating unit and an outside ambient temperature, and a driving waveform correcting unit which corrects a head driving waveform of the liquid ejecting head on the basis of a calculation result of the temperature of the liquid by the temperature calculating unit.

Another aspect of the invention is a method of ejecting a liquid using a liquid ejecting head which ejects the liquid from a nozzle passage and a heating unit which heats and dries the liquid attached to an ejection medium, so as to respond to a variation in a temperature depending on operation of the heating unit. The method comprises measuring an initial temperature at a predetermined region using a temperature measuring unit which is disposed at the predetermined region near the liquid ejecting head, calculating a temperature of the liquid ejected from the liquid ejecting head based on the initial temperature measurement and based on a temperature correction table which associates time elapsed after operation of the heating unit with a temperature of the liquid, calculating a temperature of the liquid to be ejected from the liquid ejecting head based on the a descending correction table which associates a difference between a temperature immediately after an interruption of the heating unit and an outside ambient temperature, and correcting a head driving waveform of the liquid ejecting head based on the calculation temperature of the liquid.

BRIEF DESCRIPTION OF THE DRAWINGS

The invention will be described with reference to the accompanying drawings, wherein like numbers reference like elements.

FIG. 4 is a diagram illustrating an example of a temperature correction table;

DESCRIPTION OF EXEMPLARY EMBODIMENTS

Hereinafter, a printer 10, which is a liquid ejecting apparatus, according to an embodiment of the invention will be described with reference to FIGS. 1 to 7.

Overall Configuration of Printer 10

Figure 1:
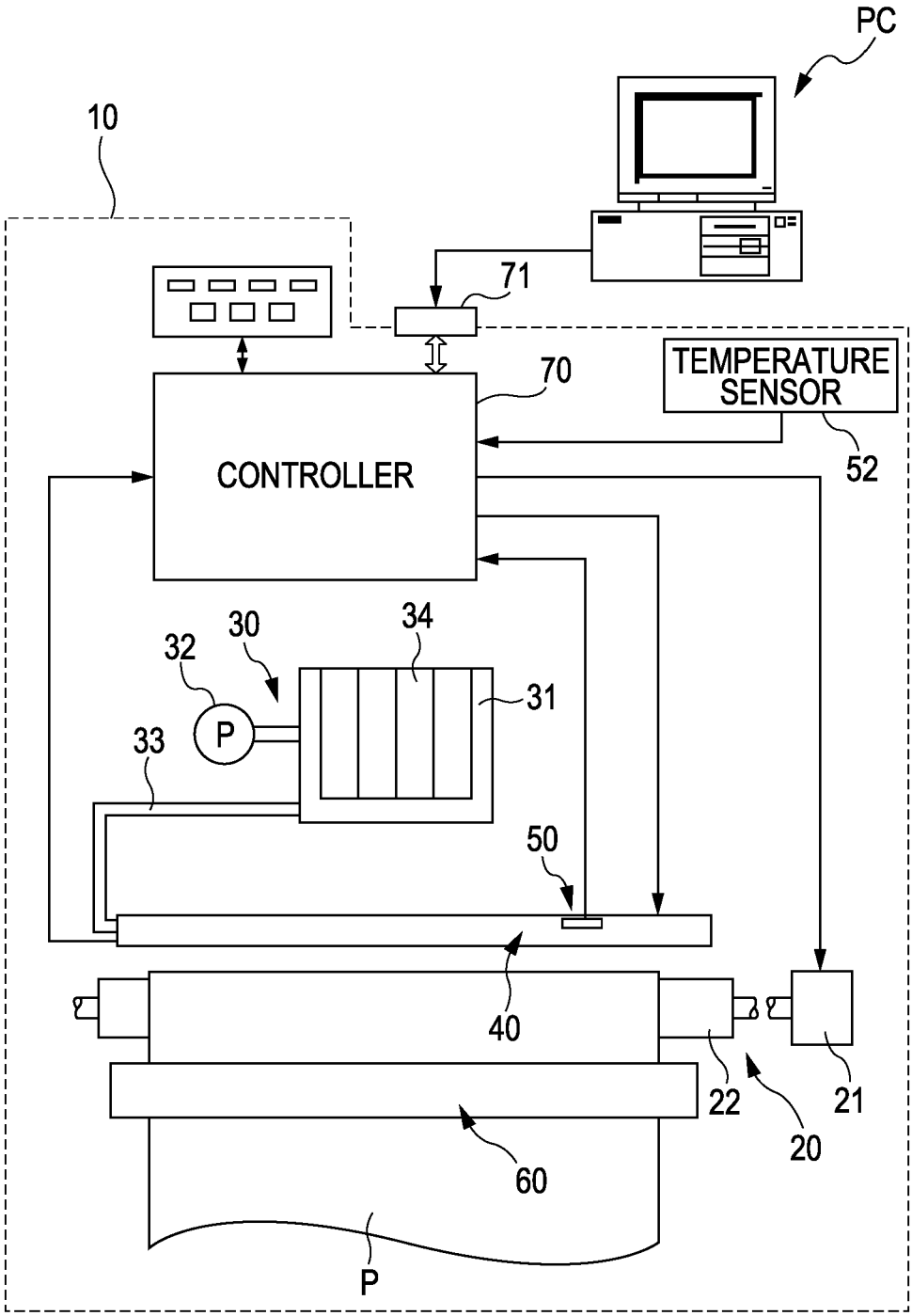
FIG. 1 is a diagram illustrating the overall configuration of a printer according to an embodiment of the invention.

The overall configuration of the printer 10 will first be described. Hereinafter, the printer 10, which includes a line head 40 and is capable of executing high-speed printing, will be described. FIG. 1 is a schematic diagram illustrating the overall configuration of the printer 10 according to one embodiment of the invention. The printer 10 according to this embodiment includes a sheet feeding mechanism 20, an ink supplying mechanism 30, the line head 40, a head thermistor 50, and a heating mechanism 60, and a controller 70 as main elements.

The sheet feeding mechanism 20 includes a sheet feeding motor (PF motor) 21 and a feeding roller 22 to which a driving force is transferred from the sheet feeding motor 21. The ink supplying mechanism 30 includes a cartridge holder 31, a pressurizing pump 32, an ink supply passage 33, and an ink cartridge 34. The cartridge holder 31 is mounted in a chassis (not shown), for example. The ink cartridge 34 is detachably mounted on the cartridge holder 31. Accordingly, the printer 10 according to this embodiment has a so-called off-carriage type configuration.

When ink, a liquid ejected from the printer 10, is supplied, the pressuring pump 32 operates to pump air into the inside of the ink cartridge 34, in order to press an ink pack, causing the ink to be ejected to the ink supply passage 33.

Figure 2:
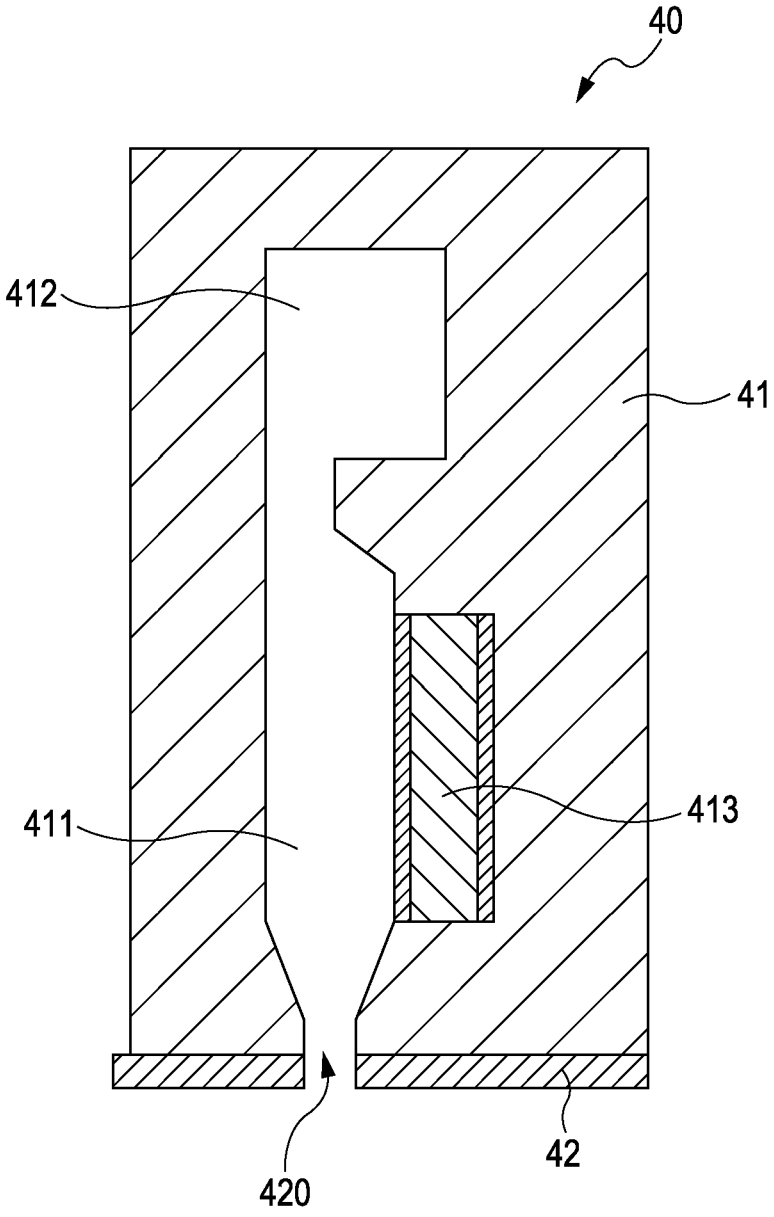
FIG. 2 is a sectional view illustrating the configuration of a line head.

The line head 40 is a liquid ejecting head. As shown in FIG. 2, the line head 40 includes a head main body 41 and a nozzle plate 42. Pressure generating chambers 411, a reservoir 412, and piezoelectric elements 413 are formed in the head main body 41 by appropriately etching a silicon substrate or the like. The nozzle plate 42 is made of SUS (Stainless Used Steel), for example. Nozzles 420 are formed in the nozzle plate 42. When the nozzle plate 42 is mounted in the head main body 41, the nozzles 420 communicate with pressure generating chambers (not shown) so as to eject the ink.

In the line head 40, a single head main body 41 with a longitudinal shape may be used or a plurality of relatively small head main bodies arranged in a zigzag configuration may be used.

The head thermistor 50 is mounted on a predetermined substrate (a head driving signal generating circuit 76 or another processing circuit) of the line head 40. The head thermistor 50, which comprises a temperature measuring unit, is a unit which measures the temperature of the line head 40. An installation region of the head thermistor 50 may be a predetermined substrate. Alternatively, the head thermistor 50 may be directly attached to the head main body 41 of the line head 40. For example, in configurations where the head thermistor 50 is directly attached to the head main body 41, the head thermistor 50 may be attached to the rear surface of the line head 40 on the upstream side in a sheet feeding direction. However, the installation region of the head thermistor 50 is not limited thereto. The head thermistor 50 may be attached to the side surface of the line head 40, the front surface of the line head 40, or the like.

In this configuration, only one head thermistor 50 is mounted in the line head 40, but as shown in FIG. 1, the number of the head thermistor 50 is not limited, and a plurality of head thermistors may be arranged at appropriate intervals. In particular, when the line head 40 includes a plurality of relatively small head main bodies 41, the head thermistor 50 may be attached to each of the head main bodies 41. In this case, a temperature correction table 74*c*, which is described below, is present in each of the relatively small head main bodies 41. Therefore, the temperature of the ink can be corrected more precisely.

When the temperature of the line head 40 is changed, the electric resistance of the head thermistor 50 is changed. The head thermistor 50 is connected to a measurement temperature outputting circuit 51. The measurement temperature outputting circuit 51 digitalizes and outputs a voltage value or a current value (referred to as a measurement value) corresponding to the electric resistance of the head thermistor 50. Then, the output measurement value is input to the controller 70, which is described below. As the temperature measuring unit, a thermocouple, a semiconductor temperature sensor, a linear resistor, a platinum resistance temperature detector, or the like may be used in addition to the head thermistor 50.

A temperature sensor 52, comprising an ambient temperature measuring unit, is mounted in the printer 10. The temperature sensor 52 is a unit which measures the outside ambient temperature of the printer 10. The temperature sensor 52 is connected to a measurement temperature outputting circuit 53 and the analog measurement value measured by the temperature sensor 52 is digitalized and output to the controller 70. As the temperature sensor 52, a thermistor similar to the head thermistor 50 may be used or a thermocouple, a semiconductor temperature sensor, a linear resistor, a platinum resistance temperature detector, or the like may be used.

Figure 3:
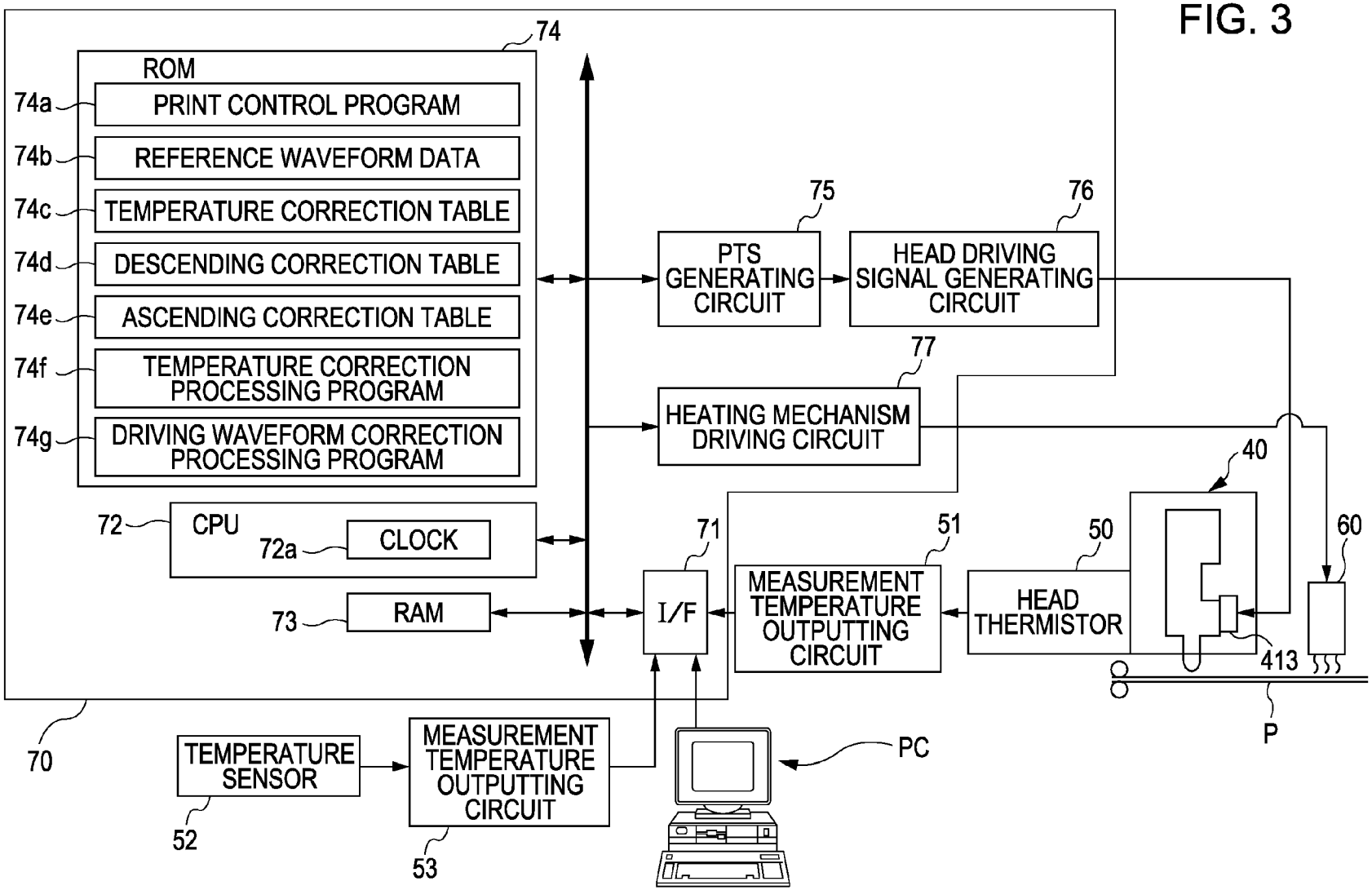
FIG. 3 is a block diagram illustrating the overall configuration of a controller and peripheral units connected to the controller.

The heating mechanism 60 comprises a heating unit. The heating mechanism 60 is a unit which heats and dries the print surface of a print medium P (corresponding to an ejection medium) subjected to printing by the line head 40, as shown in FIGS. 1 and 3. The heating mechanism 60 has a dimension so as to heat and dry the entire width of the print medium P. For example, a mechanism which radiates microwaves to the print surface to heat and dry the print surface may be used as the heating mechanism 60. Alternatively, in addition to the unit which applies microwaves, a unit which blows a hot wind to dry the print surface or a unit which heats a roller and brings the print medium P into contact with the roller to dry ink attached to the print surface may be used.

Configuration of Controller

Next, the configuration of the controller 70 will be described with reference to FIG. 3. The controller 70 includes a communication interface 71, a CPU 72, a RAM 73, a ROM 74, a PTS generating circuit 75, a head driving signal generating circuit 76, and a heating mechanism driving circuit 77.

The communication interface 71 is a circuit which communicates with a computer PC. The CPU 72 reads various data or various programs and executes various processing operations in accordance with the various programs. In addition, the CPU 72 has a clock 72*a* therein. The clock 72*a* generates a clock signal CL serving as a reference of PTS generated by the PTS generating circuit 75 which is described below.

The RAM 73 is a memory which temporarily stores various data. The ROM 74 stores various programs or various data. Therefore, even when the power of the printer 10 is turned off, the programs or the data are maintained. The programs stored in the ROM 74 include a print control program 74*a* used to operate each unit of the printer 10 and a reference waveform data 74*b* of a head driving signal which is described below.

The ROM 74 also stores a temperature correction table 74*c* (see FIGS. 4 and 5, etc.) which is used to execute temperature correction (temperature calculation), as described more fully below, based on a temperature measurement value output from the above-described measurement temperature outputting circuit 51. The ROM 74 stores a descending correction table 74*d* and an ascending correction table 74*e*, which are used to execute the same temperature correction calculation. The ROM 74 stores a temperature correction processing program 74*f* used to correct the temperature of the line head 40 based on the temperature correction table 74*c*, the descending correction table 74*d*, or the ascending correction table 74*e* stored in the ROM 74. The ROM 74 stores a head driving waveform correction processing program 74*g* used to generate correction waveform data by correcting the reference waveform data 74*b* stored in the ROM 74 on the basis of the result of the temperature correction.

When the temperature correction table 74*c* and the temperature correction processing program 74*f* are read from the ROM 74 and are executed by the CPU 72, a temperature calculating unit is functionally executed. When the head driving waveform correction processing program 74*g* is read from the ROM 74 and is executed by the CPU 72, a driving waveform correcting unit is functionally executed.

Figure 5:
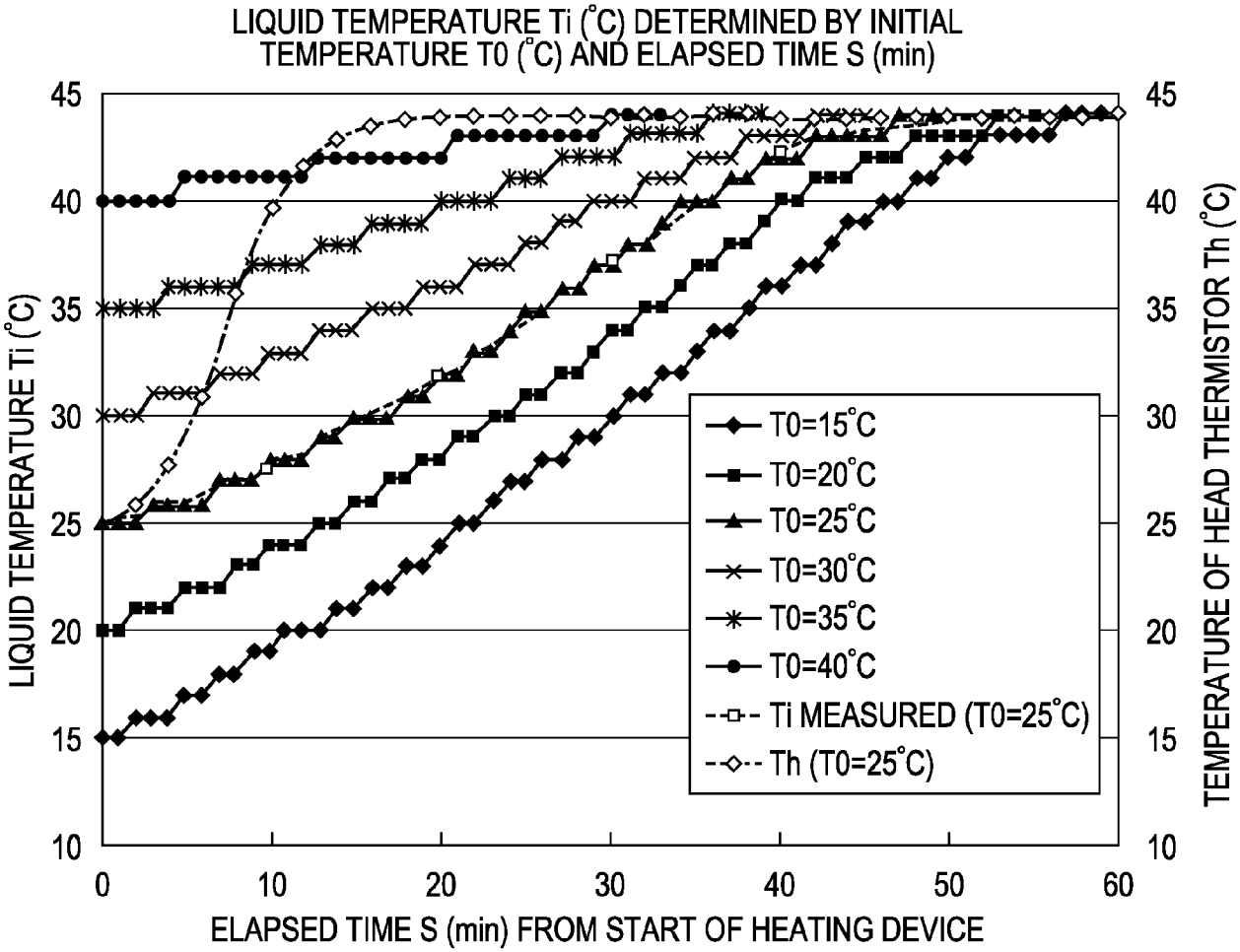
FIG. 5 is a graph illustrating a relationship between a variation in the temperature over time.
Figure 6:
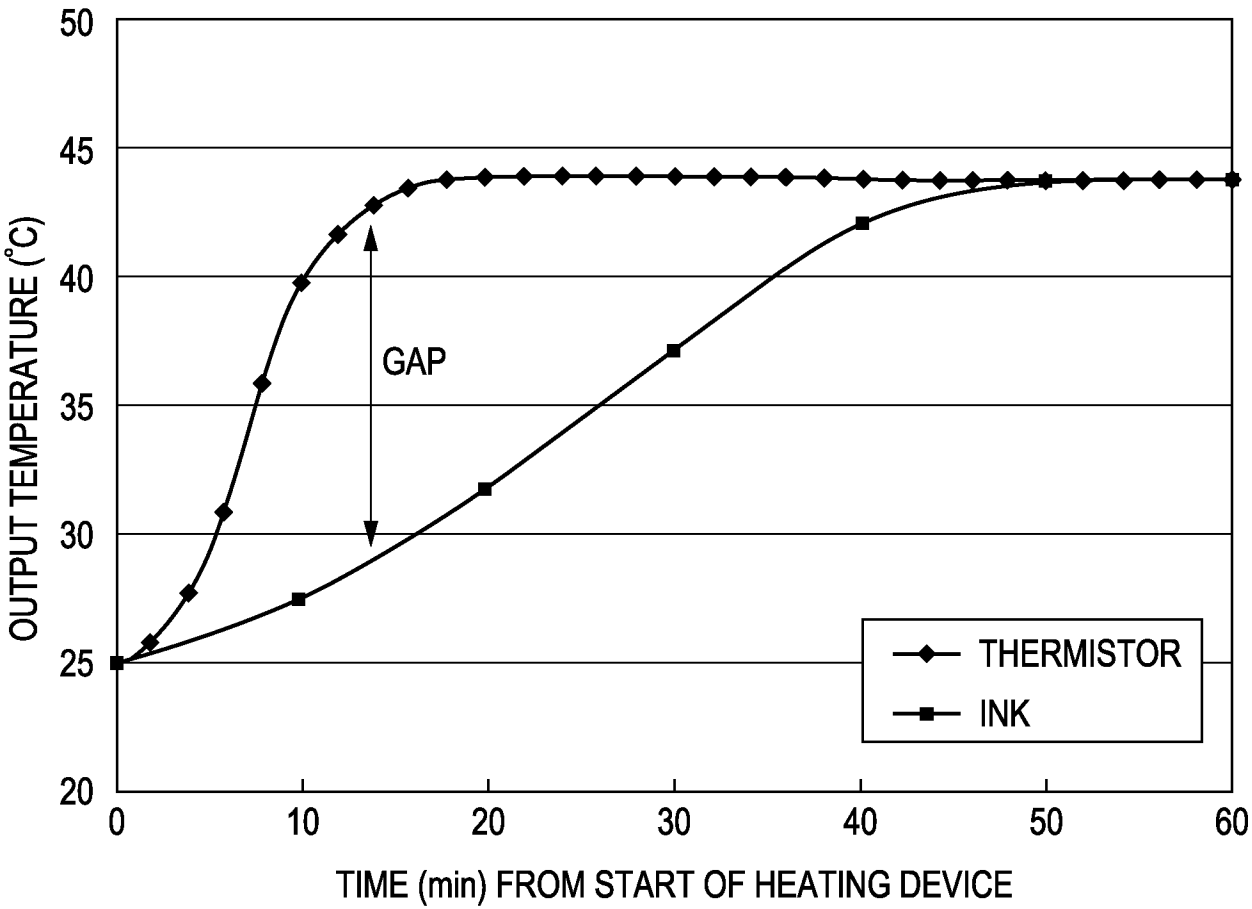
FIG. 6 is a graph illustrating a difference between the temperature detected in a head thermistor and the temperature of ink.

Here, the temperature correction table 74*c* shown in FIGS. 4 and 5 is prepared based on the result obtained by measuring the temperature of ink or the temperature in effect near the nozzles 420 by a non-contact type sensor, for example, when the heating mechanism 60 is operated. That is, the temperature measured upon initiating the operation of the heating mechanism 60 is the same as the outside ambient temperature and the temperature input via the head thermistor 50 and the measurement temperature outputting circuit 51. The temperature correction table 74*c* is prepared based on the result obtained by measuring the temperature near the nozzles 420 by the non-contact type sensor at every predetermined time from the initiation of the operation.

As shown in FIGS. 4 and 5, for example, the initial values of the temperature are present at intervals of 5° C. in the temperature correction table 74*c*. When an initially measured temperature value is a temperature between intervals, a pseudo-temperature correction table 74*c* may be calculated by a linear interpolation method or the like. In the temperature correction table 74*c*, as shown in FIGS. 4 and 5, the values of the initial temperature are calculated at intervals of 5° C. However, the initial values of the temperature may be calculated at intervals of 1° C., for example, or may be calculated at larger or smaller intervals.

Figure 9:
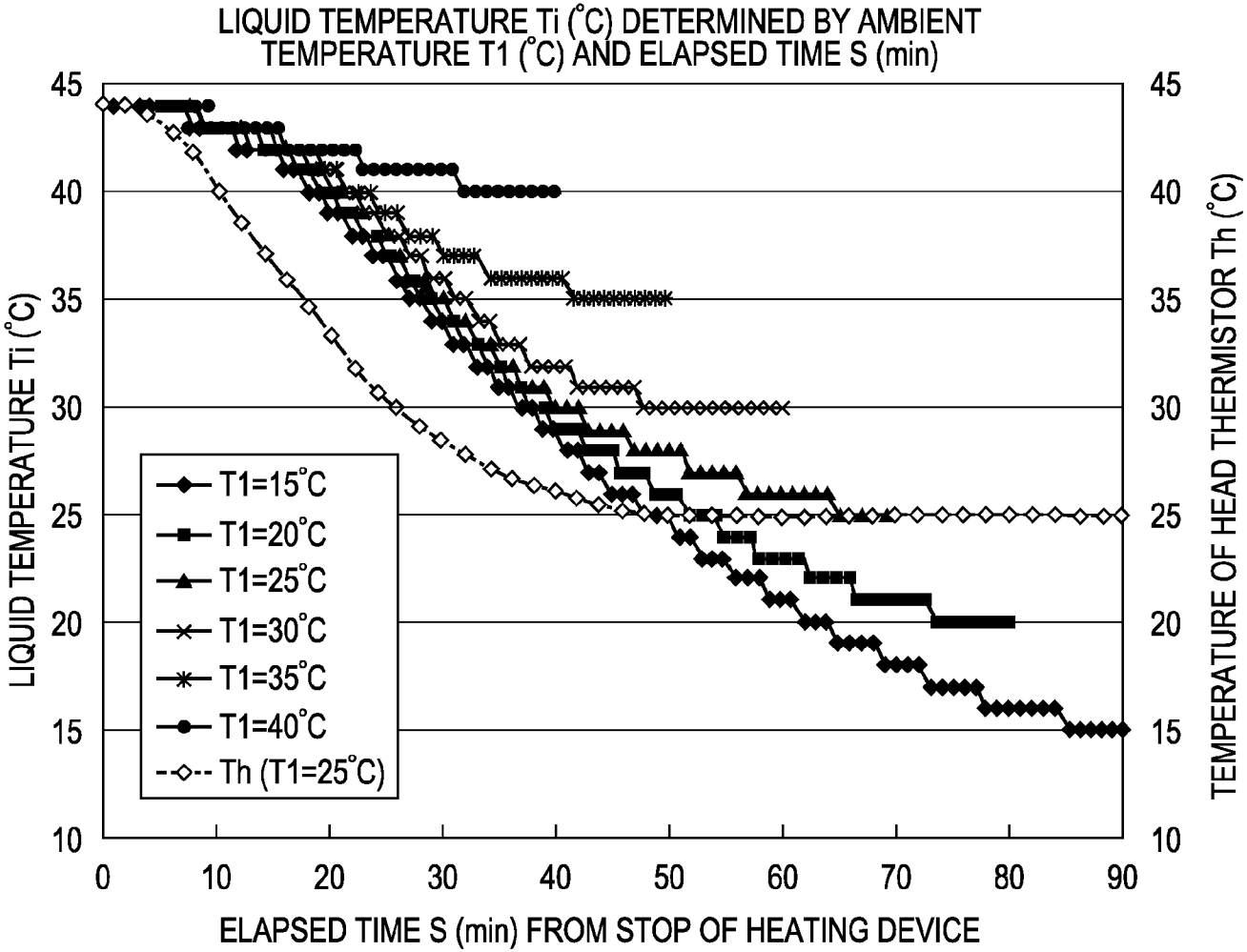
FIG. 9 is a diagram illustrating an example of a descending correction table.
Figure 10:
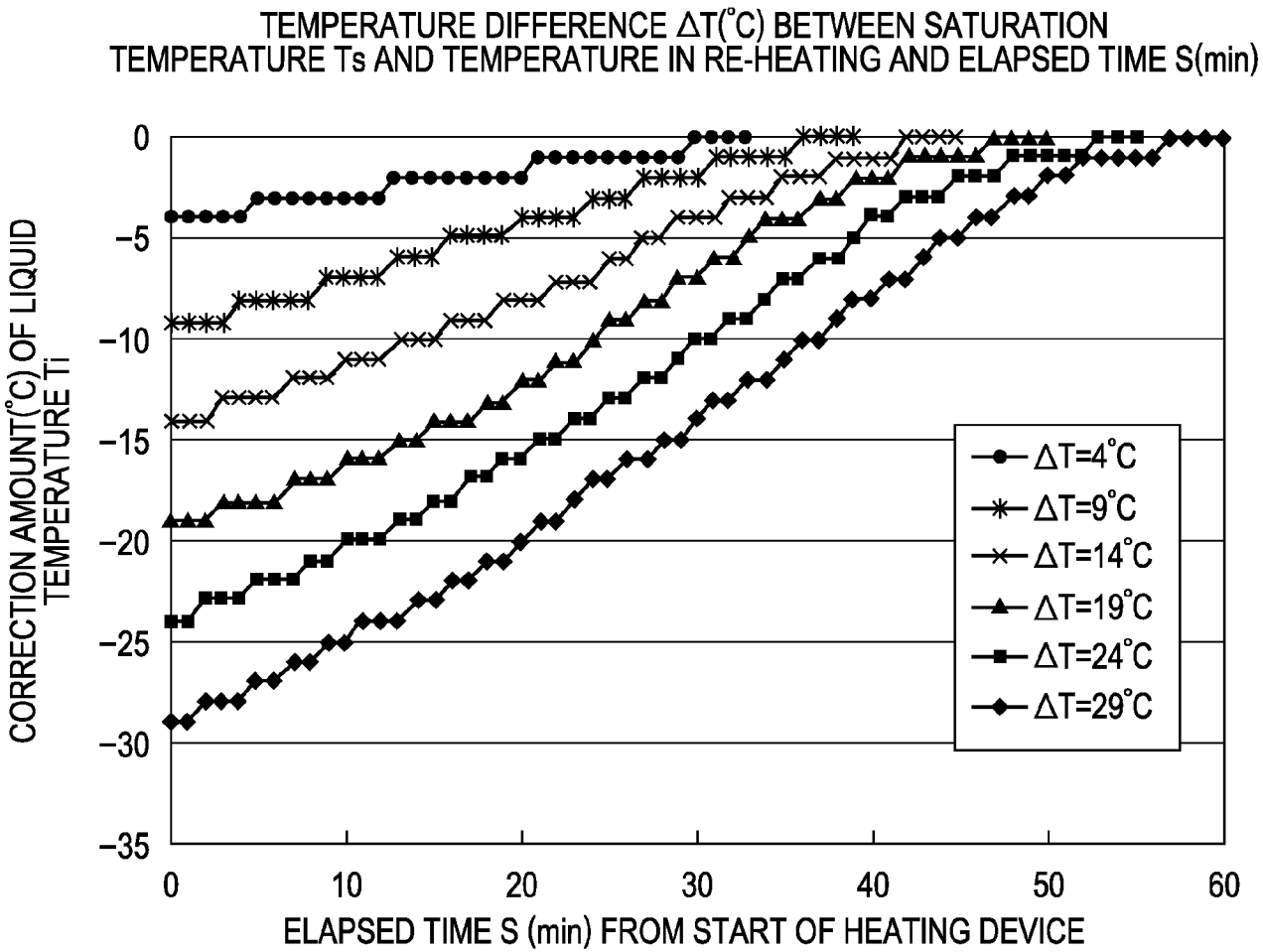
FIG. 10 is a diagram illustrating an example of an ascending correction table.

In the same manner, the descending correction table 74*d* and the ascending correction table 74*e* are prepared based on the result obtained by measuring the temperature of ink or the temperature near the nozzles 420 by a non-contact type sensor, for example, when the heating mechanism 60 is interrupted or the heating mechanism 60 is operated again (see FIGS. 9 and 10). In a graph shown in FIG. 9, a variation in the temperature of the ink is uniquely determined by what degree ΔT is. ΔT is a difference between an outside ambient temperature T1 and a temperature obtained immediately after the heating mechanism 60 is interrupted. In a graph shown in FIG. 10, a variation of the temperature of the ink is determined by ΔT. ΔT is a difference between a saturation temperature Ts and a temperature obtained immediately after the heating mechanism 60 is operated again.

In the descending correction table 74*d* and the ascending correction table 74*e*, ΔT is calculated at intervals of 5° C. Therefore, when an initially measured temperature value is present between the intervals, a pseudo-descending correction table and a pseudo-ascending correction table may be calculated by a linear interpolation method or the like. In the descending correction table 74*d* and the ascending correction table 74*e*, the initial values of the temperature may not have intervals of 5° C., 1° C., or may be present at a larger or smaller intervals.

The PTS generating circuit 75 generates a print timing signal (hereinafter, abbreviated to as PTS) of the line head 40. An encoder signal from a linear encoder (not shown), the clock signal CL from the above-described clock, and PTS generation information based on the image data processed by the CPU 71 are input to the PTS generation circuit 75. A reference PTS is generated on the basis of the signals.

The head driving signal generating circuit 76 generates the head driving signal in synchronization with the reference PTS generated by the PTS generation circuit 75. Here, the temperature correction processing program 74*f* executed by the CPU 72 does not use the temperature measurement value output from the measurement temperature outputting circuit 51, and instead uses the temperature determined in the temperature correction table 74*c*, until the heating mechanism 60 is initially operated and the temperature is saturated. Moreover, the head driving waveform correction processing program 74*g* corrects the reference waveform data 74*b* to generate the correction waveform data on the basis of the result of the temperature correction. The correction waveform data is input to the head driving signal generating circuit 76 and the head driving signal generating circuit 76 generates the head driving signal in synchronization with the reference PTS on the basis of the correction waveform data.

The heating mechanism driving circuit 77 is a circuit which controls the operation of the heating mechanism 60 based on an instruction from the CPU 72. Moreover, the heating mechanism driving circuit 77 may control the heating mechanism 60 so that the heating mechanism 60 is typically operated during the operation of the printer 10 or so that the heating mechanism 60 is operated when an image is printed on the print medium P.

Operation 1: When Heating Mechanism is not Interrupted

In the printer 10 with the above-described configuration, when the heating mechanism 60 is not interrupted, the correction of the temperature measured in the head thermistor 50 and the correction of the head driving waveform in the line head 40 are executed as follows.

First, the temperature, or, more particularly, the initial measurement value of the temperature of the line head 40, is input to the controller 70 (the CPU 72) via the head thermistor 50 and the measurement temperature outputting circuit 51. When this temperature is input, the CPU 72 executes the temperature correction processing program 74*f*.

The area around the head thermistor 50 mounted on the predetermined substrate of the line head 40 is easily heated by the operation of the heating mechanism 60. On the other hand, the ink is a liquid and an increase in the temperature is slower due to a specific heat capacity. For this reason, as apparent from FIG. 6, a large gap between the detection temperature of the head thermistor 50 and an actual temperature of the ink occurs until the temperature of the ink is saturated, compared to the actual temperature of the ink. As a consequence, a large gap is formed between the actual temperature of the ink and the detection temperature of the thermistor.

In this embodiment, the temperature correction is executed on the temperature measurement value output from the measurement temperature outputting circuit 51 on the basis of the temperature correction table 74*c* and the temperature correction processing program 74*f*. In the temperature correction, the temperature correction table 74*c* to be used is determined among the temperature correction tables 74*c* on the basis of a measured initial temperature value T0 of the output from the measurement temperature outputting circuit 51.

FIG. 5 is a graph illustrating a relationship between a variation in the temperature and elapsed time in the temperature correction table 74*c*. In FIG. 5, the plurality temperature correction tables 74*c* for the temperature are graphed. However, since one measured initial temperature value T0 is output from the measurement temperature outputting circuit 51, the temperature correction table 74*c* corresponding to one measured initial temperature value T0 is uniquely determined among the plurality of temperature correction tables 74*c*. As shown in the graph, the temperature correction processing program 74*f* calculates the current temperature of the ink based on the relationship between the used temperature correction table 74*c* and the elapsed time. In this way, the value of the temperature Ti is not calculated based on the temperature measured in the head thermistor 50. Instead, the value of the temperature Ti is calculated after this value is corrected based on the measured initial temperature value T0 measured by the head thermistor 50 and elapsed time S.

Figure 7:
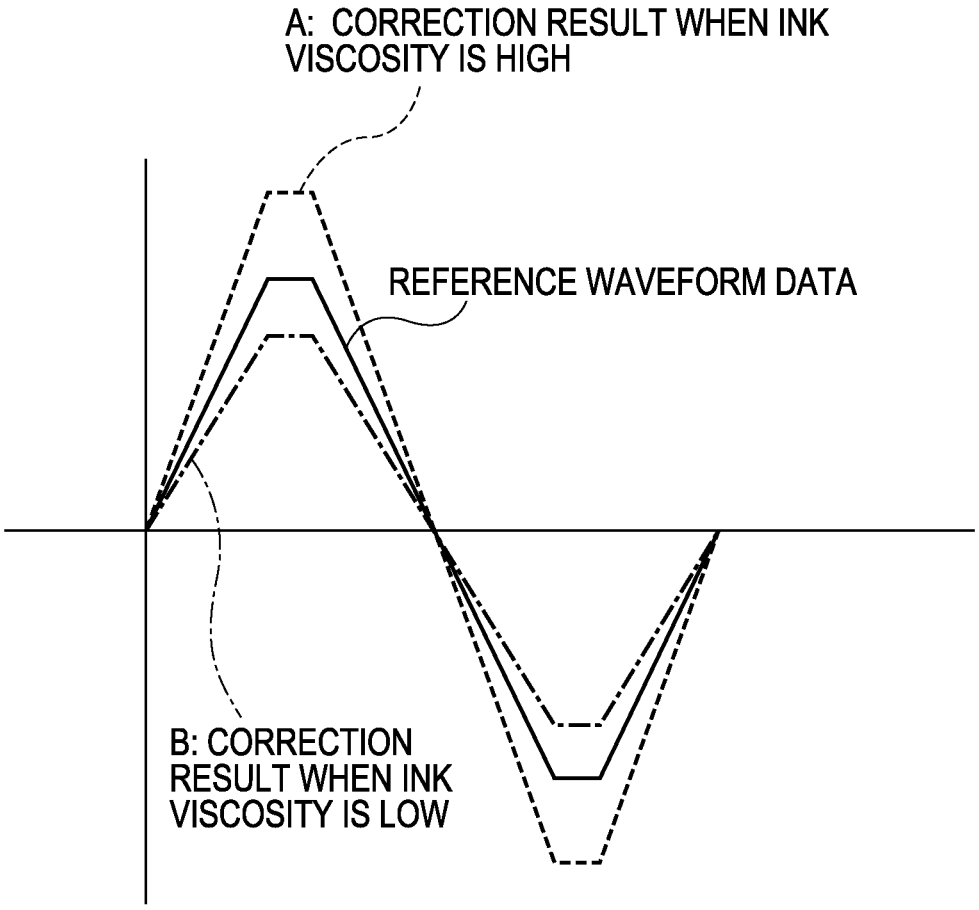
FIG. 7 is a diagram illustrating the correction of a head driving waveform.

Based on the temperature correction, the head driving waveform correction processing program 74*g* corrects the reference waveform data 74*b* and generates the corrected head driving waveform. That is, the head driving waveform correction processing program 74*g* generates correction waveform data. In FIG. 7, the correction waveform data is created and the ink viscosity varies depending on the temperature. In general, the ink viscosity is increased in a low temperature environment, while the ink viscosity is decreased in a high temperature environment. Here, since ink viscosity is increased in the low temperature environment, the reference waveform data 74*b* is corrected so that the correction waveform data is increased (see a correction result indicated by a dashed line A in FIG. 7). On the contrary, since the ink viscosity is decreased in the high temperature environment, the reference waveform data 74*b* is corrected so that the correction waveform data is decreased (see a correction result indicated by a one-dot chain line B in FIG. 7).

In a preliminary experiment to execute the correction process, a correction process may be executed such that a variation in the ink viscosity is measured at high temperature measurement point and low temperature measurement point, the ink viscosity is linearly varied between the high and low temperature measurement points, and the correction wave data is linearly increased or decreased depending on the temperature at a predetermined ratio. Alternatively, a correction process may be executed such that the variation in the ink viscosity is measured at every temperature, a correction table is made in accordance with the measured ink viscosity, and the correction wave data is increased or decreased in accordance with the correction table.

In this way, when the correction waveform data is prepared, the correction waveform data is input to the head driving signal generating circuit 76 and the head driving signal synchronized with the PTS is generated based on the correction waveform data. When the line head 40 (the piezoelectric elements 413) is driven based on the head driving signal, the ink is ejected from the nozzles 420.

As shown in the graph representing 25° C. (the temperature measured in the head thermistor 50 and the temperature shown in the temperature correction table 74*c*) in FIGS. 5 and 6, the difference between the temperature values measured in the head thermistor 50 and the temperature values shown in the temperature correction table 74*c* disappears after a long period of time elapses, and the temperature enters a saturated state. Therefore, in this embodiment, when the temperature enters the saturated state and thus the temperature is no longer increased (when the temperature is in a gray area in the temperature correction table 74*c* in FIG. 4), the result measured in the head thermistor 50 is controlled to be the same as the temperature of the ink. Alternatively, even after the temperature enters the saturated state, the control may also be executed on the basis of the temperature correction table 74*c*.

Operation 2: When Heating Mechanism is Interrupted

Next, a case where the correction of the temperature measured in the head thermistor 50 and the correction of the head driving waveform in the line head 40 are executed when the heating mechanism 60 is interrupted will be described.

Figure 8:
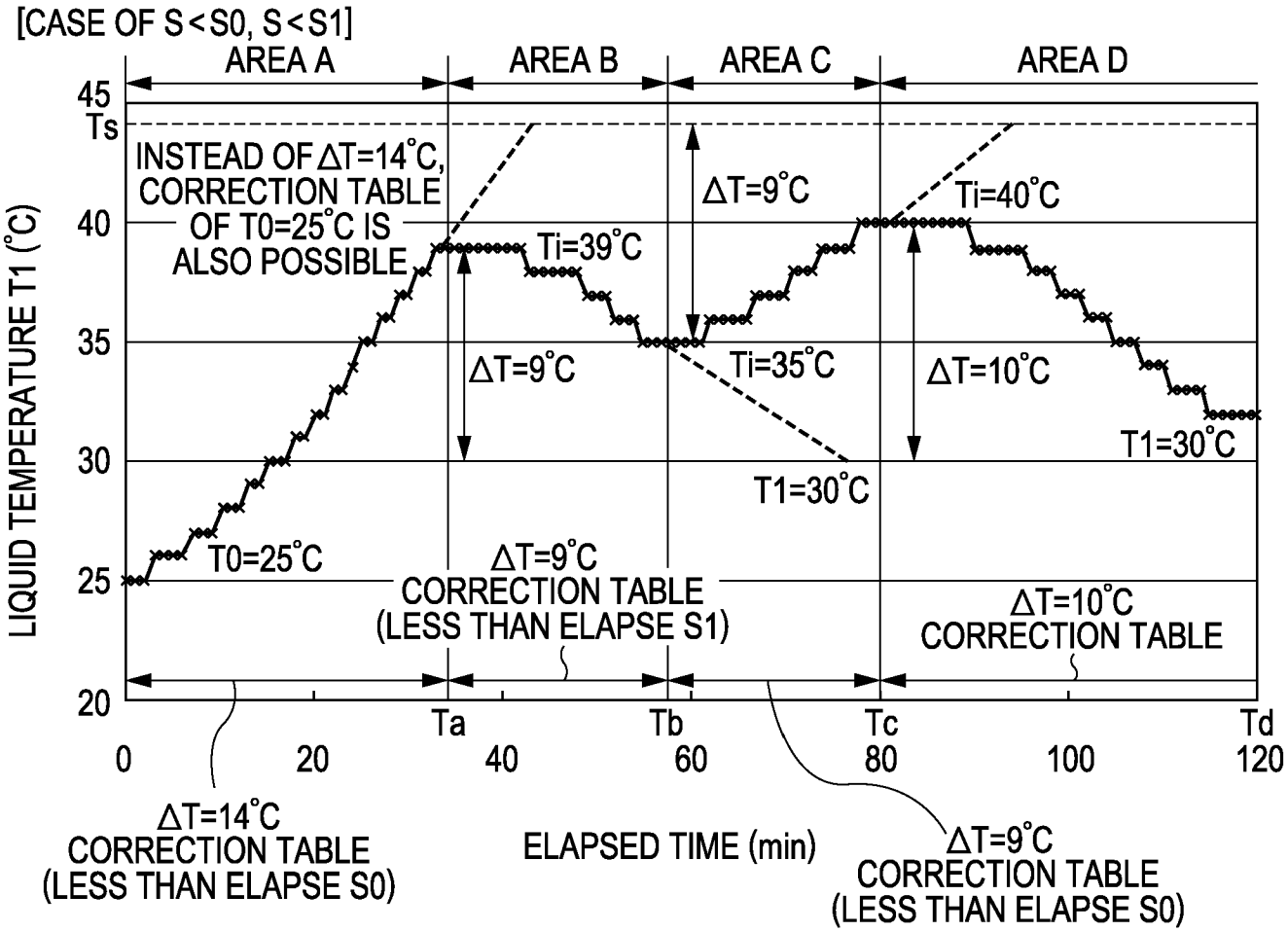
FIG. 8 is a graph illustrating a relationship between a variation in temperature based on a table and elapsed time.

In a first step of initiating the operation of the heating mechanism 60, the temperature is corrected by the temperature correction table 74*c* and the temperature correction processing program 74*f* as in Operation 1 described above. Accordingly, the temperature correction table 74*c* to be used is determined among the temperature correction tables 74*c* based on the measured initial temperature value T0 output from the measurement temperature outputting circuit 51. Then, a variation in the temperature shown in area A in FIG. 8 is shown. In the example shown in FIG. 8, the measured initial temperature value T0 is 25° C.

In FIG. 8, when the temperature of the ink reaches the outside ambient temperature T1 at time Ta (where the temperature of the ink does not drop at time Ta until the outside ambient temperature T1), the heating mechanism 60 is interrupted. Then, the temperature of the ink becomes different from the temperature measured in the head thermistor 50. The temperature of the ink gently drops to approximately the outside ambient temperature T1 of the printer 10.

In FIG. 9, the variation in the temperature is shown in a table (the descending correction table 74*d*) based on the actual measurement when the temperature of the ink is 44° C. and the outside ambient temperature T1 of the printer 10 is in the range from 15° C. to 40° C. The long dotted line in FIG. 9 indicates the variation in the temperature measured in the thermistor 50 when the outside ambient temperature is 25° C. As apparent in FIG. 9, the temperature measured in the head thermistor 50 sharply drops. However, the temperature of the ink gradually drops toward the outside ambient temperature T1 of the printer 10 due to a great specific heat capacity.

The temperature is calculated using the temperature correction processing program 74*f* and the descending correction table 74*d* after time Ta (corresponding to area B) immediately when the heating mechanism 60 is interrupted. In this way, the temperature of the ink in area B can be calculated. In the example of FIG. 8, the heating mechanism 60 is interrupted when the temperature of the ink is 39° C.

A method of determining one descending correction table 74*d* among the plurality of descending correction tables 74*d* is as follows. First, there is evaluated a difference ΔT between the outside ambient temperature T1 and the temperature obtained at time Ta immediately after the heating mechanism 60 is interrupted. In FIG. 8, the difference ΔT in area B is 9° C. A descending correction table representing the variation in the temperature of the ink between the differences ΔT is uniquely determined as the descending correction table 74*d* among the plurality of descending correction tables 74*d*.

In the plurality of descending correction tables 74*d* shown in FIG. 9, the interval of the outside ambient temperature T1 is 5° C. Therefore, when a temperature between the intervals is the outside ambient temperature T1, a pseudo-descending correction table may be calculated by a linear interpolation method or the like. In the descending correction tables 74*d*, the initial values of the temperature may not be calculated according to intervals of 5° C., as shown in FIG. 9. Alternatively, intervals of 1°, more or less, may be used.

In FIG. 8, the heating mechanism 60 is operated again at time Tb. The temperature is calculated using the temperature correction processing program 74*f* and the ascending correction table 74*e* after time Tb (corresponding to area C) when the heating mechanism 60 is operated again. In this way, the temperature of the ink can be calculated in area C. In the example of FIG. 8, the heating mechanism 60 is operated again when the temperature of the ink is 35° C.

A method of determining one ascending correction table 74*e* among the plurality of ascending correction tables 74*e* is similar to the above-described method of determining the descending correction table 74*d*. That is, there is evaluated a difference ΔT between the saturation temperature Ts and the temperature obtained at time Tb immediately after the heating mechanism 60 is operated again. In FIG. 8, the difference ΔT in area C is 9° C. An ascending correction table representing the variation in the temperature of the ink between the differences ΔT is determined to be the ascending correction table 74*e* selected from among the plurality of ascending correction tables 74*e* shown in FIG. 10.

In the graph shown in FIG. 8, the heating mechanism 60 is interrupted again at time Tc. In FIG. 8, since the temperature of the ink at time Tc is 40° C. and the outside ambient temperature T1 is 30° C., the difference ΔT in area D is 10° C. A descending correction table representing the variation in the temperature of the ink between the differences ΔT is determined to be the descending correction table 74*d* selected from among the plurality of descending correction tables 74*d*.

In this way, the temperature of the ink until time Td is calculated more precisely than that measured in the head thermistor 50. Since the generation of the head driving waveform corrected by the head driving waveform correction processing program 74*g* is the same as that in Operation 1 described above, the description is omitted.

Advantages

In the printer 10 with the above-described configuration, there is rarely a difference between the temperature detected in the head thermistor 50 and the actual temperature of the ink rarely occurs, even when the heating mechanism 60 is operated. Moreover, even when there is a difference, the difference is very slight, compared to the configurations currently known in the art. Accordingly, the head driving waveform of the line head 40 can be appropriately corrected so as to correspond to the ink viscosity of the temperature.

In particular, in this embodiment, as described in Operation 2, the temperature of the ink can easily be calculated based on the descending correction table 74*d* and the temperature correction processing program 74*f*, even when the heating mechanism 60 is interrupted. In this embodiment, the temperature of the ink can easily be calculated on the based on the ascending correction table 74*e* and the temperature correction processing program 74*f*, even when the heating mechanism 60 is operated again from the interrupted state. Accordingly, it is possible to prevent the problem that occurs when the temperature of the ink is not known after the interruption of the heating mechanism 60.

In this embodiment, a simpler configuration can be realized, as compared to a method of directly measuring the temperature of the ink or a method of appropriately arranging the predetermined number of temperature sensors. Therefore, it is possible to prevent an increase in cost. Moreover, it is possible to calculate the temperature of the ink with relatively high precision.

By using the methods of Operations 1 and 2 described above, it is possible to ensure that an appropriate amount of ink is ejected from the nozzles 420 of the line head 40. That is, since the head driving waveform can be adjusted in accordance with the ink viscosity, a stable amount of ink can continuously be ejected. As a consequence, a reliable print quality can be obtained even in a transition period during which the printer 10 is operated.

In this embodiment, the temperature of the ink is calculated based on the temperature correction table 74*c* and the descending correction table 74*d* or the ascending correction table 74*e*. Therefore, the initial temperature measurement result (initial temperature value T0) can be known from the head thermistor 50. Accordingly, when the outside ambient temperature T1 is known from the temperature sensor 52, the subsequent temperature of the ink can easily be obtained with elapsed time S, making it possible to easily calculate the temperature of the ink.

In this embodiment, the temperature correction table 74*c*, the descending correction table 74*d*, or the ascending correction table 74*e* are divided at predetermined temperatures at intervals of 5° C. In addition, when the temperature between the predetermined temperatures is the result of the measured initial temperature in the head thermistor 50, a temperature correction table between the predetermined temperatures between the 5° C. intervals may be calculated by a linear interpolation method. In this way, since the temperature of the ink can easily be obtained with elapsed time S, the temperature of the ink can be calculated.

In Operation 1, when the temperature of the ink reaches the saturation temperature Ts by the operation of the heating mechanism 60, the head driving waveform is corrected based on the temperature measurement result of the head thermistor 50, not the temperature correction table 74*c*. Accordingly, it is possible to reduce the amount of data of the temperature correction table 74*c*.

Modifications

The embodiment of the invention has been described. However, the invention is not limited thereto, but may be modified in various forms. Hereinafter, the modifications will be described.

In Operation 2 described above, the interruption-operation pattern of the heating mechanism 60 have been described in the range of area A to area D in FIG. 8. However, as long as the temperature correction table 74*c*, the descending correction table 74*d*, and the ascending correction table 74*e* described above are provided, the invention is not limited to the interruption-operation pattern of the heating mechanism 60 in FIG. 8. Even when the operation and interruption of the heating mechanism 60 are repeated several times, of course, the temperature of the ink can easily be calculated.

Furthermore, although in the above-described embodiment, the temperature calculating unit is functionally realized by reading the temperature correction table 74*c* and the temperature correction processing program 74*f* from the ROM 74 and the temperature of the ink is calculated on the basis of the temperature correction table 74*c*, the temperature of the ink may be calculated by a predetermined calculation program. In this case, the temperature of the ink is calculated by storing the predetermined calculation program in the ROM 74 and reading the calculation program.

In the above-described embodiment, the printer 10 includes the temperature sensor 52 and the descending correction table 74*d* to be used is determined from among the plurality of descending correction tables 74*d* based on the measurement of the temperature sensor 52. However, when it is considered that there is seldom a difference between the outside ambient temperature T1 and the measured initial temperature value T0 in the head thermistor 50, the temperature sensor 52 may be omitted. When the temperature sensor 52 is omitted, a simpler configuration may be realized and thus cost may further be reduced. In this case, the ascending correction table 74*e* may be omitted.

In the above-described embodiment, three correction tables (the temperature correction table 74*c*, the descending correction table 74*d*, and the ascending correction table 74*e*) have been described. However, when the increase and decrease in the temperature depend on the initial temperature value and the increase and decrease in the temperature are symmetric with respect to the boundary of a time axis, and only one correction table may be used.

In the above-described embodiment, when the ink cartridge 34 is replaced, the ambient temperature (initial temperature value) T0 may be used immediately after the ink cartridge is replaced.

In the above-described embodiment, the invention is applied to the printer 10 including the line head 40 as an example of a liquid ejecting head capable of performing aspects of the invention. However, the liquid ejecting head is not limited to the line head 40. The invention is applicable to a printing head, which serves as the liquid ejecting head, which executes a scanning operation in a main scanning direction in a direction perpendicular to a sheet feeding direction and a width direction of the print medium P.

Furthermore, the liquid ejecting apparatus may be operated as a part of a complex apparatus including a scanning apparatus and a copy apparatus. Additionally, the printer 10 is not limited to the ink jet printer, as long as the printer 10 is capable of ejecting a liquid. For example, the invention is applicable to various printers such as a gel jetting printer, a toner type printer, and a dot impact printer.

The ink jet printer 10 may also be a liquid-like material ejecting apparatus which ejects a liquid, in which a material such as an electrode material or a color material (pixel material) is dispersed or dissolved, and which is used to manufacture a liquid crystal display, an EL (Electro Luminescence) display, and a field emission display, a liquid ejecting apparatus which ejects a bio organic matter used to manufacture a bio chip, and a liquid ejecting apparatus which ejects a liquid used as a sample as a precision pipette.

Examples of the liquid ejecting apparatus include: a liquid ejecting apparatus that ejects lubricant to a precision instrument such as a watch or a camera by the use of a pinpoint; a liquid ejecting apparatus that ejects on a substrate a transparent resin liquid such as ultraviolet cure resin to form a fine hemispheric lens (optical lens) for an optical communication element; a liquid ejecting apparatus that ejects an etchant such as acid or alkali to etch a substrate; and a fluid state material ejecting printing apparatus which ejects a fluid state material such as a gel (for example, physical gel). The invention is applicable to one of these liquid ejecting apparatuses.

What is claimed is:

1. A liquid ejecting apparatus comprising:

a liquid ejecting head which ejects a liquid from a nozzle to an ejection medium;

a heating unit which heats and dries the liquid ejected to the ejection medium, wherein the heating unit is separate from the liquid ejecting head so as to be able to heat and dry the ejected liquid;

a temperature measuring unit which is disposed at a predetermined region near the liquid ejecting head and measures a temperature of the predetermined region;

a temperature calculating unit which calculates a temperature of the liquid based on a temperature measurement of the temperature measuring unit, an amount of time elapsed after operation of the heating unit and an outside ambient temperature; and a driving waveform correcting unit which corrects a head driving waveform of the liquid ejecting head on the basis of a calculation result by the temperature calculating unit, wherein a viscosity of the liquid is increased when the temperature of the liquid is low such that that a corrected head driving waveform is increased relative to the reference head driving waveform, and wherein the viscosity of the liquid is decreased when the temperature of the liquid is high such that that the corrected head driving waveform is decreased relative to the reference head driving waveform.

2. The liquid ejecting apparatus according to claim 1, wherein the outside ambient temperature is measured by an ambient temperature measuring unit.

3. The liquid ejecting apparatus according to claim 1, wherein the temperature calculating unit calculates a temperature of the liquid based on the descending correction table, and continuously calculates a temperature of the liquid to be ejected from the liquid ejecting head based on an ascending correction table which associates a difference between a temperature elapsed immediately after the operation of the heating unit and a saturation temperature upon heating the liquid with operation time, when the heating unit again operates again after being in the interrupted state.

4. The liquid ejecting apparatus according to claim 1, wherein the temperature correction table, the descending correction table, or an ascending correction table is present for every predetermined temperature, and wherein when a temperature between the predetermined temperatures is the initial temperature measurement result of the temperature measuring unit, the temperature correction table, the descending correction table, or the ascending correction table between the predetermined temperatures is calculated by linear interpolation.

5. The liquid ejecting apparatus according to claim 1, wherein the liquid ejecting head is a line head in which a plurality of head main bodies are arranged, wherein the temperature correction calculating unit calculates temperatures of the liquid corresponding to a plurality of the head main bodies, and wherein the driving waveform correcting unit corrects a reference head driving waveform corresponding to a plurality of the head main bodies.

6. A method of ejecting a liquid using a liquid ejecting head which ejects the liquid from a nozzle passage and a heating unit which heats and dries the liquid attached to an ejection medium, so as to respond to a variation in a temperature depending on operation of the heating unit, the method comprising:

measuring an initial temperature at a predetermined region using a temperature measuring unit which is disposed at the predetermined region near the liquid ejecting head;

calculating a temperature of the liquid based on the initial temperature measurement, and an amount of time elapsed after operation of the heating unit, and an outside ambient temperature; and correcting a reference head driving waveform of the liquid ejecting head based on the calculation temperature of the liquid, wherein the heating unit is separate from the liquid ejecting head so as to be able to heat and dry the ejected liquid, wherein a viscosity of the liquid is increased when the temperature of the liquid is low such that that a corrected head driving waveform is increased relative to the reference head driving waveform, and wherein the viscosity of the liquid is decreased when the temperature of the liquid is high such that that the corrected head driving waveform is decreased relative to the reference head driving waveform.

7. A liquid ejecting apparatus comprising:

a liquid ejecting head which ejects a liquid from a nozzle to an ejection medium;

a heating unit which heats and dries the liquid ejected to the ejection medium, wherein the heating unit is separate from the liquid ejecting head so as to be able to heat and dry the ejected liquid;

a temperature measuring unit which is disposed at a predetermined region near the liquid ejecting head and measures a temperature of the predetermined region;

a temperature calculating unit which calculates a temperature of the liquid ejected based on a temperature measurement of the temperature measuring unit, an amount of time elapsed after operation of the heating unit, and an outside ambient temperature; and a driving waveform correcting unit which corrects a head driving waveform of the liquid ejecting head on the basis of a calculation result by the temperature calculating unit, wherein the outside ambient temperature is measured by an ambient temperature measuring unit, wherein a viscosity of the liquid is increased when the temperature of the liquid is low such that that a corrected head driving waveform is increased relative to a reference head driving waveform, and wherein the viscosity of the liquid is decreased when the temperature of the liquid is high such that that the corrected head driving waveform is decreased relative to the reference head driving waveform.

* * * * *